US005118389A

United States Patent [19]

Dubelsten et al.

[11] Patent Number: 5,118,389

[45] Date of Patent: Jun. 2, 1992

[54] TWO-STAGE PEROXIDE BLEACHING PROCESS USING DIFFERENT AMOUNTS OF PEROXIDE ON DIFFERENT PORTIONS OF MECHANICAL PULP

[75] Inventors: Paul Dubelsten, Mississauga; Christopher J. Kanters; John R. Du Manoir, both of Oakville, all of Canada

[73] Assignee: ICI Canada Inc., North York, Canada

[21] Appl. No.: 549,145

[22] Filed: Jul. 6, 1990

[51] Int. Cl.[5] ..... D21C 9/16; D21C 27/00

[52] U.S. Cl. ..... 162/19; 162/40; 162/41; 162/78; 162/123

[58] Field of Search ..... 162/78, 126, 123, 130, 162/19, 40, 41

[56] References Cited

U.S. PATENT DOCUMENTS

| | | | |
|---|---|---|---|
| 2,942,661 | 6/1960 | Beachler | 162/123 |
| 3,147,178 | 9/1964 | Sowa | 162/126 |
| 4,731,160 | 3/1988 | Prough et al. | 162/78 |
| 4,915,785 | 4/1990 | Siminoski et al. | 162/78 |

OTHER PUBLICATIONS

Lachenal et al., "Two-stage peroxide bleaching of mechanical pulp", *Pulp & Paper Canada*. Paper Presented Jun. 1988 at Orlando, Fla., at the Int. Pulp Bleaching Conf. of the Tech Sect, CPPA.

C. Gagne, M. C. Barbe and C. Deneault, "Comparison of Bleaching Processes for Mechanical and Chemimechanical Pulps", Tappi, 71 (11), pp. 89-98 (1988).

*Primary Examiner*—Steve Alvo

*Attorney, Agent, or Firm*—C. Brian Barlow

[57] ABSTRACT

A continuous two-stage peroxide bleaching process operated in a single bleach plant for producing a bleached pulp of high brightness, having a second stage bleaching step using a high charge of peroxide followed by a washing stage to recover the residual liquor containing a substantial amount of the applied peroxide. The residual liquor is recycled and used for bleaching in the first stage. Only a portion of the pulp bleached in the first stage is treated in the second stage. Two or more bleached pulp products can be produced simultaneously. The bleached pulp products can be used to form different layers of a multi-layer paper products.

12 Claims, 1 Drawing Sheet

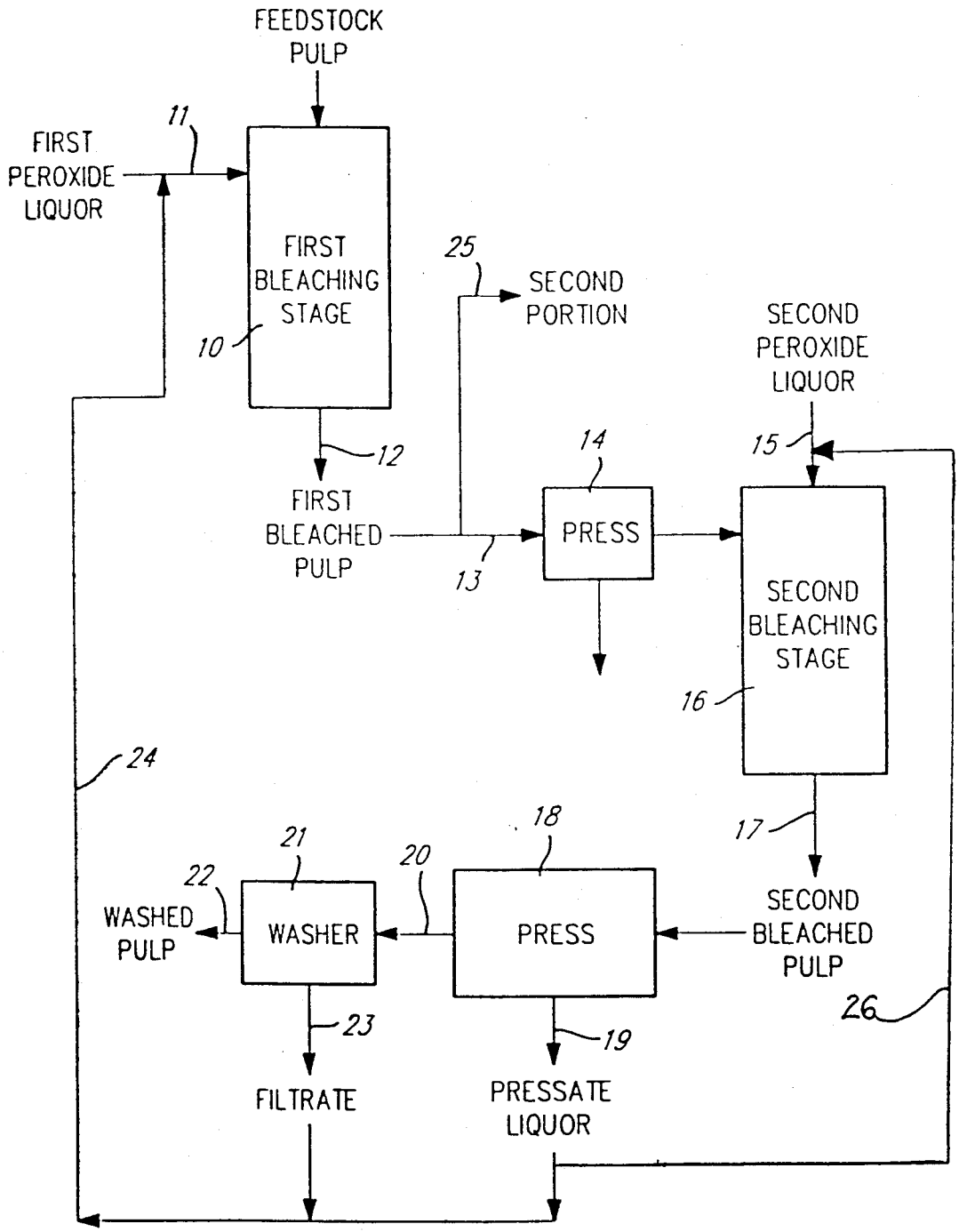
FEEDSTOCK PULP
FIRST PEROXIDE LIQUOR
11
FIRST BLEACHING STAGE
10
12
FIRST BLEACHED PULP
25
SECOND PORTION
13
14
PRESS
SECOND PEROXIDE LIQUOR
15
SECOND BLEACHING STAGE
16
17
SECOND BLEACHED PULP
24
18
PRESS
20
21
WASHER
22
WASHED PULP
23
FILTRATE
19
PRESSATE LIQUOR
26

TWO-STAGE PEROXIDE BLEACHING PROCESS USING DIFFERENT AMOUNTS OF PEROXIDE ON DIFFERENT PORTIONS OF MECHANICAL PULP

FIELD OF THE INVENTION

The present invention relates to the bleaching of mechanical pulps with peroxide, and in particular to bleaching of mechanical pulps with hydrogen peroxide in two stages.

BACKGROUND OF THE INVENTION

It is known that the brightness gain of a mechanical pulp subjected to hydrogen peroxide bleaching increases with both the amount of peroxide applied to the pulp and the amount of peroxide consumed by the pulp. In an effort to obtain mechanical pulps of high brightness, the utilization of greater concentrations of hydrogen peroxide is being widely investigated. Most commonly, bleaching of mechanical pulps is carried out in a single stage, but as more and more peroxide is applied in a single stage, the amount of unused peroxide that does not contribute to the bleaching increases, and this results in an increase in the wasteful non-bleaching reactions of the peroxide, and/or a high peroxide residual remaining at the end of the bleach.

Two stage bleaching processes were developed in order to more effectively utilize hydrogen peroxide for bleaching to obtain higher brightnesses, i.e. to optimize the consumption of peroxide by the pulp for the purpose of bleaching. Processes for one stage, two stage and three stage bleaching have been compared in an article by C. Gagne, M. C. Barbe and C. Daneault, Tappi, November 1988, p. 89. In the two stage bleaching process with peroxide described therein, and which process is typical of two stage bleaching with peroxide, there are two bleaching towers connected in series. Displacement-washing screw presses are included for thickening the pulp either prior to the inlet of the first bleaching tower or between the first and second towers. The residual peroxide from the second tower is reused in the first tower, and the whole white water system is countercurrent for washing or pretreating the pulp. This process is reported to allow for better use of peroxide and to provide brightness gains at lower cost. In such conventional types of multi-stage peroxide bleaching configurations, there is a sequential treatment of the entire feedstock pulp, and the residual liquor containing peroxide from the final peroxide bleaching tower is separated from the bleached pulp by pressing.

In these processes, the quality of the resultant bleached pulp is governed by the sequential treatment that the entire batch of pulp receives, and the process is thus limited to the production of a single quality of product at a time. The residual liquor containing peroxide is separated by pressing, and there are practical limitations to the volume of liquor that can be reasonably separated from a pulp by pressing means. As the charge of peroxide utilized in the final bleaching stage increases to obtain a higher brightness pulp, which as a consequence thereof the amount of peroxide in the residual liquor increases, then a proportionately greater absolute amount of peroxide will remain on the bleached pulp after pressing, and will be lost. Any attempt at washing the bleached pulp to more completely remove and collect the peroxide would afford a filtrate liquor containing peroxide that is of too low a concentration to be effectively utilized in a primary bleaching stage.

U.S. Pat. No. 4,915,785 in the name of C-I-L Inc., issued Apr. 10, 1990, discloses a rapid single stage process for the bleaching of mechanical pulp to enhanced brightness levels with hydrogen peroxide. In the process disclosed therein, substantially greater charge of hydrogen peroxide and accompanying additives are utilized in a single bleaching stage to provide pulps of enhanced brightness in a short period of time. This process provides a residual liquor that contains a substantial amount of peroxide. In a preferred embodiment of the invention described therein the residual liquor is recycled to a pulping or bleaching process.

SUMMARY OF THE INVENTION

Surprisingly, we have now found that the residual peroxide remaining after a second stage of bleaching using high charges of peroxide, to produce a pulp of high brightness in a two-stage peroxide bleaching process, can be effectively utilized by the combination of treating only a portion of the pulp bleached in the first stage in this second stage, and using a washing stage to provide a filtrate containing a substantial amount of the residual peroxide remaining after the second stage, which filtrate is recycled to the first stage.

It is an object of the present invention to effectively recover and utilize the residual peroxide remaining after a high brightness peroxide bleaching stage.

It is a further object of the present invention to optionally produce multiple grades of bleached pulps simultaneously in a continuous process in a single bleach plant.

It is a further object of the present invention to provide for increasing the throughput of an existing single stage peroxide bleach plant by converting it to a two-stage peroxide bleaching process as hereinafter defined.

Accordingly, the present invention provides a continuous two-stage bleaching process operated in a single bleach plant, which continuous process comprises:

treating a mechanical pulp feedstock in a first stage with a first peroxide liquor containing a sufficient charge of hydrogen peroxide on pulp to provide a first bleached pulp of a desired first brightness;

treating a first portion of said first bleached pulp in a second bleaching stage with an aqueous bleaching composition comprising greater than about 10 percent by weight on pulp of hydrogen peroxide to provide a second bleached pulp of a desired enhanced second brightness and a residual peroxide liquor;

collecting a second portion of said first bleached pulp;

separating said residual peroxide liquor from said second bleached pulp to provide a separated residual peroxide liquor and a separated bleached pulp;

recycling a portion of said separated residual peroxide liquor to said first stage wherein said first peroxide liquor comprises said separated residual peroxide liquor; and collecting said separated second bleached pulp.

The separated second bleached pulp may be optionally added to said second portion of said first bleached pulp to provide an admixture of resultant desired brightness pulp. A second portion of the separated residual peroxide liquor may be optionally fed to the second stage for treating said first portion of said first bleached pulp.

In a preferred feature of the invention, the residual peroxide liquor is separated from the second bleached pulp by washing to provide a washed second bleached pulp and a filtrate, which filtrate is fed to the first stage wherein the first peroxide liquor comprises said filtrate. Optionally, a portion of said filtrate is fed to the second bleaching stage for treatment of said first portion of the first bleached pulp.

In a more preferred embodiment of the present invention the residual peroxide liquor is separated from the second bleached pulp by pressing the second bleached pulp to provide a pressate liquor and a pressed pulp; the pressate liquor is fed to the first stage wherein said first peroxide liquor comprises said pressate liquor; the pressed pulp is washed in a washing stage to provide a washed pulp and a filtrate; and the filtrate is also fed to the first stage wherein the first peroxide liquor further comprises said filtrate. Optionally, the pressate liquor, or a portion thereof, is fed to the second stage, and the first portion of first bleached pulp is treated with said pressate liquor.

Mechanical pulps suitable for use in the present invention include stone groundwood, thermomechanical pulp (TMP) and chemically treated high yield pulps including chemimechanical pulp (CMP) and chemi-thermomechanical pulp (CTMP), and variations thereon.

In the practise of the process according to the present invention a mechanical pulp feedstock is treated in a first bleaching stage with a first peroxide bleaching liquor containing a sufficient charge of hydrogen peroxide to provide a first bleached pulp of desired first brightness. The first peroxide liquor containing hydrogen peroxide comprises said residual liquor separated from the second bleached pulp. The amount of hydrogen peroxide contained in the first peroxide liquor is preferably selected in the range from about 0.5% to about 10% $H_2O_2$ by weight on pulp, and more preferably from about 1% to about 6% by weight on pulp. The desired first brightness of said first bleached pulp is preferably selected from the range of about 58% ISO to about 78% ISO brightness, and preferably from about 62% to about 75% ISO. The bleaching with hydrogen peroxide in the first stage may be conducted in any manner known in the art for providing a bleached pulp of the said desired brightness.

The separation of the residual liquor from the second bleached pulp may be accomplished according to any of the standard separation techniques known in the art, such as by filtration or by pressing. Thus, the first peroxide liquor for use in treating the feedstock pulp comprises the filtrate from the washing of the second bleached pulp, or the filtrate and the pressate as defined herein. It is highly desirable that the first peroxide liquor is constituted by the whole of the filtrate, and preferably is constituted by the whole of the filtrate and pressate.

In the processes according to the invention "make-up" liquor comprising hydrogen peroxide, magnesium sulphate, base and sodium silicate entities may be added with the first and/or second peroxide liquor or at any other appropriate entry to the continuous two-stage process.

It will be understood that other chemicals conventionally utilized as additives for stabilization or pH adjustment, such as silicate or hydroxide, may be required to fortify the recycled liquors used in the first stage in order to make up for additives that are lost or used up in carrying out the process defined herein. Particularly, it will be understood that fortification of the recycled liquor may be necessary in order to provide the appropriate alkalinity for the bleaching treatment in the first stage. This is accomplished by the addition of a suitable base, such as sodium hydroxide, in order to obtain a pH in the range between 9 and 11.

Further, according to the process of the present invention, the first bleached pulp is split to provide a first portion of the first bleached pulp, preferably wherein said first portion is an amount selected in the range from about 5% to about 35% by weight of the total first bleached pulp. The first portion of the first bleached pulp is treated in a second bleaching stage to provide a second bleached pulp of a desired second brightness and a residual liquor. However, prior to treatment in the second stage, the first portion of the first bleached pulp is preferably pressed to raise its consistency in order to permit the addition of a suitable amount of the second peroxide liquor. The second peroxide liquor for use in treating the first portion of the first bleached pulp contains a substantially greater amount of peroxide, percent on pulp, of the order as disclosed in U.S. Pat. No. 4,915,785, than is contained in the first peroxide liquor. The second liquor may comprise fresh peroxide and/or said pressate liquor. The second desired brightness of the second bleached pulp produced in the second stage is preferably of an enhanced brightness greater than about 78% ISO, and more preferably greater than about 82% ISO.

In a further feature of the present invention, the first portion of the first bleached pulp is treated in the second stage at a pH selected in the range from about 9 to about 11 in a second peroxide liquor comprising greater than about 10 percent by weight on pulp of hydrogen peroxide, and magnesium ion and sodium silicate and a base in weight ratios and sufficient amounts to substantially reduce the wasteful, non-bleaching reactions of hydrogen peroxide; and for a sufficient period of time to effect enhanced brightness of said pulp; and to produce a second bleached pulp of an enhanced brightness and a residual peroxide liquor.

The magnesium ion is provided by a suitable magnesium salt that is compatible with hydrogen peroxide, such as magnesium sulphate, and the amount of magnesium ion is preferably selected in the range from about 0.04 percent to about 2 percent by weight on pulp. Alternative peroxide stabilizers, such as nitrogen-containing chelating agents, may be employed in place of, or in addition to, the magnesium ion.

The weight ratio of hydrogen peroxide:sodium silicate is preferably selected in the range from about 1:1 to about 6:1. Also, the weight ratio of sodium silicate:base is preferably selected in the range from about 1:1 to about 4:1, wherein the base is expressed on a sodium hydroxide basis. Also, preferably, said second peroxide liquor contains an amount of hydrogen peroxide selected in the range from about 10% to about 100% by weight on pulp.

The treatment in the second stage, for a short period of time, is preferably less than about 40 minutes, and more preferably less than about 15 minutes. Also, the treatment of the pulp in the second stage is carried out at a pulp consistency selected in the range from about 8% to about 35%, and at a temperature selected in the range from about 40° C. to 90° C. The treatment in the second stage may comprise passing a continuous flow of the second peroxide liquor through a bed of the pulp.

The second peroxide liquor may comprise a portion of the residual liquor separated from the second bleached pulp. The separation may be effected as hereinabove described. Thus, the second peroxide liquor may comprise at least a portion of the pressate. Fresh hydrogen peroxide is used as a supplement to said pressate in order to provide a sufficient amount of peroxide in said second peroxide liquor as hereindefined.

In the second stage of bleaching described hereinabove a residual liquor remains at the end of the bleach. This residual liquor contains a substantial amount of the peroxide used to produce the second bleached pulp. The residual liquor is separated from the second bleached pulp and is recycled to the first stage, and optionally to the second stage. The residual liquor may be separated by a washing stage, or preferably by pressing to provide a pressate liquor containing hydrogen peroxide and a pressed pulp, followed by washing said pressed pulp in a washing stage. The pressate liquor may be used for lowering the consistency of the second bleached pulp at the end of bleaching in the second stage and just prior to pressing. The pressing is preferably performed to provide a pressed second bleached pulp of as high a consistency as is practicable, e.g. greater or equal to 35% consistency. Following the pressing, the pressed pulp is reconstituted, i.e. its consistency is lowered in order to accomplish effective washing. This washing may be carried out by any suitable washing method known in the art, including displacement as a means of removing residual peroxide from the second bleached pulp. It is highly desirable to use the first washings of the wash stage. The washings of the wash stage are referred to hereinabove as the filtrate.

The split of the first bleached pulp into first and second portions depends on the amount of peroxide contained in the residual liquor and the volume of the residual liquor separated from the second bleached pulp after the second stage of bleaching, such that the separated liquor is suitable for use as the first peroxide liquor for treating the feedstock mechanical pulp. Preferably, the split is selected such that the first peroxide liquor is constituted by the whole of the separated residual liquor. The amount of peroxide contained in the second peroxide liquor is selected accordingly.

In a further aspect of the invention there is provided a paper product having a first layer comprising a second portion of the first bleached pulp adjacent a second layer comprising the second bleached pulp, wherein the first and second bleached pulps are produced according to the process defined hereinabove. In a preferred embodiment, the first layer is an inner layer sandwiched between two outer layers comprising the second bleached pulp.

BRIEF DESCRIPTION OF THE DRAWING

The single FIGURE shows a schematic of the disclosed process.

DETAILED DESCRIPTION OF THE INVENTION

In order that the invention may be better understood, preferred embodiments will now be described by way of example only, with reference to the accompanying FIGURE. In the flow diagram of the FIGURE, a feedstock mechanical pulp is treated in a first bleaching stage (10) with a first peroxide liquor (11) containing a sufficient amount of hydrogen peroxide to provide a first bleached pulp (12) of desired first brightness. The first bleached pulp (12) is split into two portions. A first portion (13), comprising from about 5% to about 35% of the first bleached pulp (12), is treated in a press (14) to raise the consistency so that a second peroxide liquor (15) can be added to provide a treatment consistency from about 8% to about 35% in the second stage of bleaching (16). The second peroxide liquor (15) contains a substantially greater amount of hydrogen peroxide than is contained in the first peroxide liquor (11) in order to provide a second bleached pulp (17) of enhanced brightness, admixed with a residual liquor. The residual liquor is separated from the second bleached pulp (17) by employing a press (18) to provide a pressate liquor (19) and a pressed pulp (20). Further residual liquor is removed from the pressed pulp (20) by using a washer (21) to provide a washed pulp (22) and a filtrate (23). The pressate liquor (19) and the filtrate (23) are combined and recycled in line 24 to the first stage of bleaching wherein the first peroxide liquor comprises said combined pressate and filtrate.

In one embodiment, a portion of pressate liquor (19) may be recycled in line (26) to the second bleaching stage (16) so that the second perioxide liquor (15) comprises a portion of pressate liquor (19).

The amount of the first portion (13) of the first bleached pulp to be treated in the second stage of bleaching (16) is selected such that the combined pressate liquor (19) and the filtrate (23) provide a bleach liquor composition containing hydrogen peroxide that is suitable for use as the first peroxide liquor (11). Also, the amount of hydrogen peroxide contained in the whole of the combined pressate and filtrate liquors, as governed by the treatment in the second stage of bleaching, as well as the volume of said combined liquors, are selected to be suitable for use as the first peroxide liquor such that when combined with the feedstock mechanical pulp, provides a pulp consistency in the first stage typical to peroxide bleaching, i.e. a consistency substantially between 8% and 35%.

The process of the present invention may be used to produce multiple grades of bleached pulps simultaneously in a continuous process. If desired, at least two grades of bleached pulps may be produced; a first grade defined by a second portion (25) of the first bleached pulp having a brightness defined by the desired first brightness, and a second grade defined by the desired brightness of the second bleached pulp (22). Further, if desired, a third grade of bleached pulp may be produced having a desired third brightness selected in the range between said desired first and second brightnesses, by mixing together sufficient amounts of the pulps having the desired first and the second brightnesses. The simultaneous production in a single bleach plant of at least 2 grades of pulp of differing brightnesses as described hereinabove, is particularly useful for the production of layered paper sheets wherein a layer made from a grade of pulp of lower brightness is sandwiched between layers of a grade of pulp of higher brightness.

By having the treatment in the second stage for a short period of time, as described hereinabove, there is the opportunity of increasing the throughput of the bleach plant compared to conventional bleaching processes. It will be understood by those skilled in the art that as the amount of peroxide on pulp increases in the first stage owing to a greater amount of peroxide contained in the residual liquor recycled to said stage, or owing to a greater supplement of fresh peroxide being added to said first stage, or both, that the treatment time, or retention time in said first stage can be decreased, thus increasing the throughput of the bleach plant.

The present invention will now be illustrated by way of a preferred example.

EXAMPLE 1

An Eastern Canadian softwood groundwood pulp (25 g O.D., 60.6% ISO brightness) was treated with an aqueous composition containing 2% (by weight on pulp) of 100% hydrogen peroxide, 4% (by weight on pulp) of 41.Be sodium silicate, 0.05% (by weight on pulp) of magnesium sulfate and 1.0% (by weight on pulp) of sodium hydroxide. The pulp slurry at 12% consistency was thoroughly mixed and then heated in a polyethylene bag at 60° for 120 minutes in a static fashion (A). At the end of the reaction period, residual liquor was separated from the pulp by suction filtration in order to simulate pressing. Following filtration, the pulp was washed at 1% consistency with water.

After washing, the pulp was once again suction filtered to 30% consistency. The brightness of the pulp was determined to be 74.3% ISO. The pulp was then split into two portions. The first portion contained 15% of the first bleached pulp while the second portion contained 85% of the pulp. The first portion (15%) was treated with an aqueous composition containing 10% (by weight on pulp) of 100% hydrogen peroxide, 4% (by weight on pulp) of 41. Be sodium silicate, 0.5% (by weight on pulp) magnesium sulfate and 3% (by weight on pulp) of sodium hydroxide. The pulp slurry at 15% consistency was thoroughly mixed and heated in a polyethylene bag at 60° C. for 15 minutes in a static fashion. The residual liquor was then separated from the pulp by suction filtration in order to simulate pressing, and provide a pressate liquor. Following pressing, the pulp was washed once with water at 4.0% consistency and then suction filtered to 30% consistency in order to provide a filtrate liquor. The final brightness of this pulp was in excess of 84% ISO brightness.

The pressate and filtrate liquors were combined and a residual peroxide determination was carried out. Seventy percent of the original charge of peroxide used in the second stage was recovered. This solution was then added with mixing, to 25 g O.D. of unbleached Eastern Canadian softwood groundwood pulp corresponding to a peroxide charge of approximately 1% by weight on pulp. Dilution water was added to bring the consistency to 12%. The pulp was placed in a polyethylene bag and treated at 60° C. for 120 minutes in a static fashion. The process, continuing from (A) above, was then repeated.

EXAMPLE 2

The process of Example 1 wherein the split of the first bleached pulp to provide first and second portions is varied. The charges of hydrogen peroxide used in each of the first and second bleaching stages is listed in Table I. The hydrogen peroxide used to constitute the second peroxide liquor was fresh hydrogen peroxide and was varied. The first peroxide liquor in each case was constituted by the whole of said combined pressate and filtrate liquors. The washing was carried out at the consistencies listed in the Table. The first bleached pulp was pressed to 30% consistency prior to being split as listed in the Table. The first portion of the first bleached pulp was not washed i.e. only pressed, prior to being treated in the second stage of bleaching at 15% consistency. The results are listed in Table I.

| SAMPLE # | FIRST PORTION OF FIRST BLEACHED PULP TO SECOND STAGE (% by weight) | SECOND PEROXIDE LIQUOR (% $H_2O_2$ ON PULP) | RESIDUAL LIQUOR % $H_2O_2$ RESIDUAL (OF CHARGE) | WASH STAGE (% CONS'Y) |
|---|---|---|---|---|
| 1 | 5.0 | 15.0 | 70.0 | 1.0 |
| 2 | 5.0 | 15.0 | 95.0 | 4.0 |
| 3 | 5.0 | 25.0 | 80.0 | 4.0 |
| 4 | 6.0 | 10.0 | 85.0 | 1.0 |
| 5 | 10.0 | 10.0 | 90.0 | 2.0 |
| 6 | 10.0 | 50.0 | 90.0 | 4.0 |
| 7 | 10.0 | 20.0 | 85.0 | 2.0 |
| 8 | 15.0 | 10.0 | 70.0 | 4.0 |
| 9 | 15.0 | 25.0 | 75.0 | 4.0 |
| 10 | 15.0 | 30.0 | 95.0 | 4.0 |
| 11 | 20.0 | 10.0 | 70.0 | 3.0 |
| 12 | 20.0 | 15.0 | 80.0 | 4.0 |
| 13 | 20.0 | 30.0 | 85.0 | 3.0 |
| 14 | 25.0 | 10.0 | 70.0 | 3.0 |
| 15 | 25.0 | 20.0 | 90.0 | 4.0 |
| 16 | 25.0 | 30.0 | 75.0 | 3.0 |
| 17 | 30.0 | 10.0 | 75.0 | 4.0 |
| 18 | 30.0 | 15.0 | 85.0 | 4.0 |

| SAMPLE # | CONC. OF $H_2O_2$ SOL'N (% by weight) RECYCLED TO FIRST STAGE | COMBINED PRESSATE & FILTRATE USED AS FIRST PEROXIDE LIQUOR (% $H_2O_2$ ON PULP) | CONS'Y OF FIRST STAGE IF RECYCLED $H_2O_2$ SOL'N IS ADDED TO O.D. PULP |
|---|---|---|---|
| 1 | 0.10 | 0.52 | 17 |
| 2 | 0.55 | 0.68 | 44 |
| 3 | 0.77 | 1.0 | 44 |
| 4 | 0.08 | 0.51 | 14 |
| 5 | 0.18 | 0.88 | 17 |
| 6 | 1.7 | 4.3 | 29 |
| 7 | 0.33 | 1.7 | 17 |
| 8 | 0.27 | 1.0 | 21 |
| 9 | 0.72 | 2.7 | 21 |
| 10 | 1.1 | 4.1 | 21 |
| 11 | 0.20 | 1.4 | 13 |
| 12 | 0.46 | 2.3 | 17 |
| 13 | 0.74 | 5.0 | 13 |

-continued

| | | | |
|---|---|---|---|
| 14 | 0.20 | 1.7 | 11 |
| 15 | 0.69 | 4.3 | 14 |
| 16 | 0.65 | 5.5 | 11 |
| 17 | 0.29 | 2.2 | 12 |
| 18 | 0.49 | 3.7 | 12 |

CONDITIONS
*First stage treatment as described in Example 1
*Second stage treatment at 15% pulp consistency
*Pulp pressed to 30% consistency after treatment in second bleaching stage and prior to washing
*Pressed pulp washed at consistency shown in Table 1 with thickening to 30% consistency.

The embodiments of the invention in which an exclusive property or privilege is claimed are defined as follows:

1. A continuous two-stage bleaching process operated in a single bleach plant, which continuous process comprises:

treating a mechanical pulp feedstock in a first stage with a first peroxide liquor containing a sufficient charge of 0.5-10% hydrogen peroxide on pulp to provide a first bleached pulp of a desired first brightness;

treating a first portion of said bleached pulp in a second bleaching stage with an aqueous bleaching composition comprising greater than about 10 percent by weight on pulp of hydrogen peroxide to provide a second bleached pulp of a desired enhanced second brightness and a residual peroxide liquor;

collecting a second portion of said first bleached pulp to obtain a pulp grade having a first brightness;

separating said residual peroxide liquor from said second bleached pulp to provide a separated residual peroxide liquor and a separated bleached pulp;

recycling a portion of said separated residual peroxide liquor to said first stage wherein said first peroxide liquor comprises said separated residual peroxide liquor; and collecting said separated second bleached pulp to obtain a pulp grade having a second brightness.

2. A process as claimed in claim 1, wherein said first portion of the first bleached pulp is an amount selected in the range from about 5% to about 35% by weight of said first bleached pulp.

3. A process as claimed in claim 1, wherein said residual peroxide liquor is separated from said second bleached pulp by washing to provide a washed second bleached pulp and a filtrate; and feeding and filtrate to said first stage wherein said first peroxide liquor comprises said filtrate.

4. A process as claimed in claim 3, wherein said first peroxide liquor consists of said filtrate provided by said washing.

5. A process as claimed in claim 1, wherein said residual peroxide liquor is separated from said second bleached pulp by pressing to provide a pressate liquor and a pressed pulp;

feeding said pressate liquor to said first stage wherein said first peroxide liquor comprises said pressate liquor;

washing said pressed pulp in a washing stage to provide a pressed and washed second bleached pulp and a filtrate; and feeding said filtrate to said first stage wherein said first peroxide liquor comprises said pressate liquor and said filtrate.

6. A process as claimed in claim 5, wherein said first peroxide liquor comprises the whole of said filtrate provided by said washing.

7. A process as claimed in claim 5, wherein said first peroxide liquor comprises the whole of said pressate liquor provided by the pressing.

8. A process as claimed in claim 5, wherein a portion of the pressate liquor is fed to said second stage such that said second peroxide liquor comprises said portion of the pressate liquor.

9. A process as claimed in claim 1, wherein said first portion of said first bleached pulp is treated in said second stage at a pH selected from the range of about 9 to about 11 in said second peroxide liquor comprising greater than about 10% by weight on pulp of hydrogen peroxide, and magnesium ion and sodium silicate and a base in weight ratios and sufficient amounts to substantially reduce wasteful, non-bleaching reactions of hydrogen peroxide; and for a sufficient period of time to produce said second bleached pulp of said desired second brightness and said residual peroxide liquor.

10. A process as claimed in claim 1, wherein a sufficient amount of said second bleached pulp is mixed with a second portion of said first bleached pulp to provide a bleached pulp product of desired third brightness.

11. A process for preparing a paper product comprising:

i) providing a first layer comprised of a second portion of said first bleached pulp; and ii) providing a second layer, adjacent said first layer, comprised of said second bleached pulp, wherein said first and second bleached pulps are provided by a process as claimed in claim 1.

12. A process as claimed in claim 11 further comprising providing an additional layer of said second bleached pulp also adjacent to said first layer so that said first layer is an inner layer sandwiched between two outer layers comprising said second bleached pulp.

* * * * *